United States Patent [19]

Astolfi

[11] Patent Number: 4,707,937

[45] Date of Patent: Nov. 24, 1987

[54] ELEMENT FOR SECURING AND HANGING PICTURE FRAMES

[75] Inventor: Pietro Astolfi, Bologna, Italy

[73] Assignee: Pico-Glass, Italy

[21] Appl. No.: 776,323

[22] Filed: Sep. 16, 1985

[30] Foreign Application Priority Data

Sep. 21, 1984 [IT] Italy ..... 5041/84[U]

[51] Int. Cl.[4] ..... G09F 1/12

[52] U.S. Cl. ..... 40/152.1; 40/10 R; 40/156

[58] Field of Search ..... 40/11, 11 A, 10 R, 152.1, 40/156, 152

[56] References Cited

U.S. PATENT DOCUMENTS

| | | | |
|---|---|---|---|
| 3,981,091 | 9/1976 | Wiener | 40/156 |
| 4,078,326 | 3/1978 | Reim | 40/152.1 |
| 4,217,710 | 8/1980 | Becker | 40/156 |
| 4,261,123 | 4/1981 | Mariotti | 40/152.1 |

*Primary Examiner*—Gene Mancene
*Assistant Examiner*—Wenceslao J. Contreras
*Attorney, Agent, or Firm*—Darby & Darby

[57] ABSTRACT

A clip is provided shaped to retain a picture within its frame and with an aperture by which the assembly may be hung from a support.

3 Claims, 5 Drawing Figures

FIG. 2
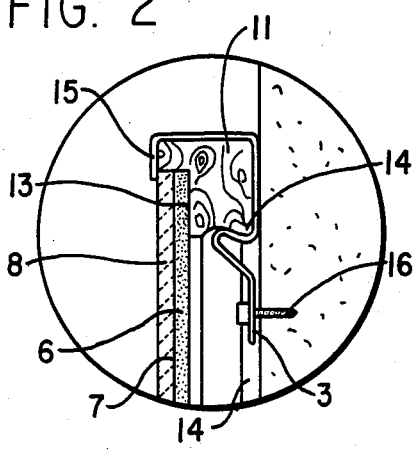
FIG. 3A FIG. 3B
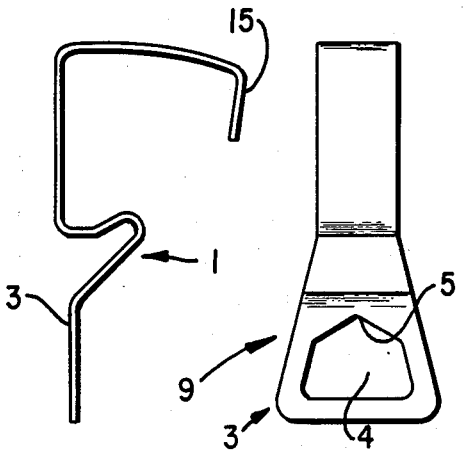
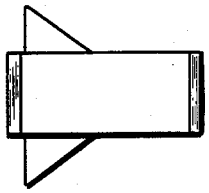
FIG. 3C
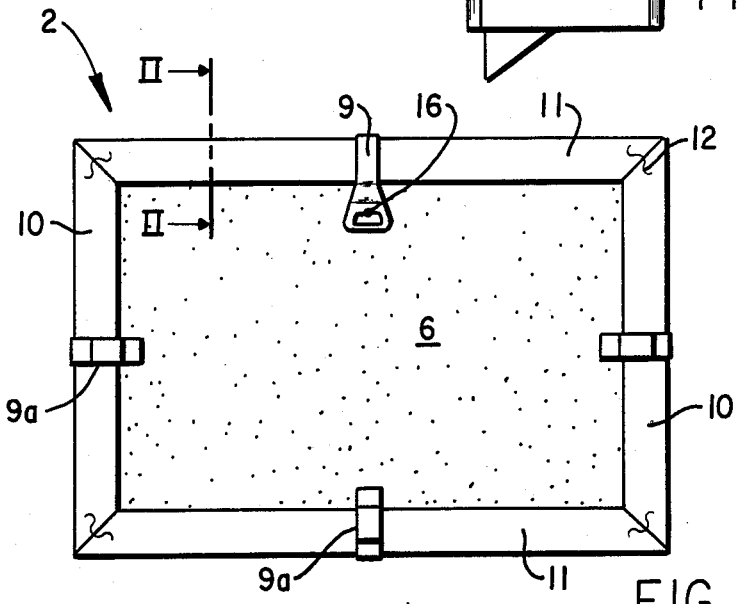
FIG. 1

ELEMENT FOR SECURING AND HANGING PICTURE FRAMES

SUMMARY

An element for securing frames of the type with a closed external border towards the front of which there is a seat for the image, it's support and a transparent surface, and at the back of which a protrusion for coupling. Said securing element is shaped like the letter G with one end jutting out over the transparent surface whilst the other end first wraps itself around the coupling piece then bends towards the inside of the external border. In order to provide a more practical and functional hanging element, the end which bends towards the inside of the external border presents an enlargement with a triangular hole pointing towards the outside of the external border.

DESCRIPTION

The device in question has as its objective an element for securing and hanging frames. On the market of items for displaying images there are many different types of frames made using a variety of materials such as metal, plastics and, of course, wood.

Amongst the frames made in wood there are some which at the back have a seat for the transparent surface, normally glass, for the image and the support for same, to which are applied one or more elements to support and hang the finished frame. The front of this type of frame can be engraved or worked in some way to improve it's appearance but which also results in rendering it markedly more expensive.

A more simple and economical type of frame which at the same time has a pleasing appearance, is that which has a seat at the front and the supporting elements of which are also used for securing the transparent surface, the image and the image support to the frame.

Such frames are made up of a closed external border at the front of which is created the said seat and at the back of which there is a protrusion which curves towards the inside of the frame and onto which are applied the securing or holding elements.

These securing elements more or less conform to the shape of the letter G and jut out at one end over the front of the external border and on to the transparent surface whilst the other end wraps around the said protrusion gripping the same. This end is then bent towards the inside of the external border thus acting as a spring grip for releasing the said securing element from the external border.

The part of such securing elements in contact with the back of the external border is slightly raised which creates a gap along this side of the external border in which is lodged one side of an element bent into a triangular shape which is then hung on a nail or whatever is fixed to fix the frame to the wall.

This triangular element, however, even if cheap and simple to make, presents several disadvantages; for example it should be applied to the securing element before this in turn is applied to the external border and during this operation it can slide about, unnecessarily complicating a simple operation.

Another disadvantage is when the triangular element slides off completely and falls on the floor where often it cannot be easily found.

When the frame is hung on an element with an intermediate piece, for example a hook or rounded end, the triangular element forces the frame into a position which is not perfectly perpendicular.

A further disadvantage from an esthetic point of view is the fact that the nail or the element which substitutes it is always on view.

The scope of the device in question is thus that of creating a securing element which conforms to the objectivs already described but which is economical, easy and safe to use.

These objectives are reached by a securing element conforming to the device in question for the type of frames with a closed external border with a seat at the front for the support of the image, the image and a covering transparent surface and at the back a coupling piece which curves towards the inside of the external border, said securing element conforming substantially to the shape of the letter G and wrapped around a piece of the external border, said securing element jutting out with the first end over the external border and on to the transparent surface and with the second end wrapped around the said coupling piece of the external border, said securing element being bent towards the inside of the external border, such securing element differentiating itself by the fact that its second end which is bent towards the inside of the border is enlarged and has a hole, said hole being more or less triangular in shape with the top pointing towards the outside of the external border, said enlargement being more or less parallel to the inside of the back face of said external border. An advantage of such securing element is the fact that by using it there is no further need for the triangular element for hanging the frame.

Another advantage of the foreseen enlargement of the end which wraps around the coupling piece is inside of the external border so that in the first place the picture covers completely the nail by which it is hung and secondly permits the use of intermediary pieces which protrude since this enlargement is never in line with the back of the external border but slightly internal.

The foreseen hole in the enlargement of the end in the shape of a triangle with top towards the outside of the external border further allows the automatic positioning of the hanging element in relation to the nail.

Said characteristics and advantages of the device in question will become more evident from the detailed description which follows in the form of a practical realization of the securing and hanging element illustrated in the figures of the attached sketch in which:

FIG. 1 is a rear view of a frame with the securing and hanging element in question.

FIG. 2 is a cross-section of the part II—II of FIG. 1.

FIG. 3A shows a side elevational view of a securing element.

FIG. 3B is a front elevational view of the securing element.

FIG. 3C is a bottom plan view of the securing element.

Observing the figures of the entire sketch it can be seen that the picture frame illustrated is composed of a frame 2, a support 6 for the image, the image 7, a transparent surface 8, normally glass, and the securing elements 9. The frame 2 has been realized as a closed external border made of two vertical uprights 10 and two horizontal transversals 11 linked to one another by means of appropriate wavy blades 12. The frame 2 presents, at the front, a seat 13 for the support 6 of the image 7, for the image 7 and for the transparent surface 8 and at the rear a protrusion for coupling 14 turned towards the inside of the said frame 2.

The securing elements 9 are more or less shaped like a G and wrap around the outside of the respective upright 10 or transversal 11. Each element 9 (see FIG. 2) juts out with its end 15 over the front of the respective upright 10 or transversal 11 onto the transparent surface 8 and grips with its other end 1 the coupling piece 14 of the frame 2. This second end 1 of the element 9 is bent towards the inside of the frame 2 acting as a spring for the removal of the said elements 9 from the frame 2. In the securing elements 9 in question this second end 1 is lengthened further and ends with the enlargement 3.

The enlargement 3 has a hole 4 which is basically triangular in shape, the top of which 5 points towards the outside of the frame 2. The enlargement 3 is furthermore substantially parallel to the rear side of the frame 2 and inside with respect to the same face.

The mounting of these securing elements 9 is carried out in the same way as those already noted 9*a* but in this case no additional element is necessary to hang the whole picture frame. In fact it is sufficient to place the frame near the wall making sure that the nail 16 finds its way into the hole 4 of the upper element 9. Letting the picture frame fall delicately, the same moves itself laterally until the top 5 of the hole 4 of the element 9 finds itself in contact with the nail 16.

With the example illustrated in the figures a nail poking out of the wall without intermediary elements has been designed, but in the case that the nail used has the latter, the slight recession of the enlargement 3 in respect of the rear side of the frame 2 is able to compensate for the thickness of such intermediate elements.

In practice modifications and/or improvements which enter into the ambit of the following claims are clearly possible.

I claim:

1. A clip for securing a picture and a covering sheet to a frame having top and bottom and side sections, said frame having on a front side a peripherally recessed seat for holding said picture and covering sheet so that said frame front side and said covering sheet are approximately flush, said frame also having a central rear opening bounded by said top and bottom and side sections, said clip comprising:

a bent resilient member having first, second, third, fourth and fifth portions, each portion being contiguously joined to the next successive portion, said first portion being joined to said second portion at an angle of approximately ninety degrees, said first portion having a length sufficient to extend from an outer edge of said frame to slightly within the periphery of said recessed seat, said second portion being joined to said third portion at an angle of approximately ninety degrees, said second portion being adapted to extend from said front to a rear side of said frame and not substantially further rearward, said third portion being joined to said fourth portion at an angle of approximately ninety degrees in the forward direction generally toward said clip first portion, for resiliently and securely holding said clip and frame together, said fifth portion being joined to said fourth portion at an angle and extending into said rear central opening in a direction generally parallel to said picture.

2. The clip according to claim 1, wherein said fifth portion has an opening therethrough for engaging means for fastening said picture to a surface on which said picture is to be placed.

3. The clip according to claim 2, wherein said fifth portion opening has a triangular portion, with one corner of said triangular portion generally oriented toward said clip third portion.

* * * * *